US012747592B2

(12) United States Patent
Yildirim et al.

(10) Patent No.: US 12,747,592 B2
(45) Date of Patent: Sep. 29, 2026

(54) BUILDING PROFILE AS WELL AS METHOD AND INSTALLATIONS FOR MANUFACTURING A BUILDING PROFILE

(71) Applicant: BFC Fahrzeugteile GmbH, Bietigheim-Bissingen (DE)

(72) Inventors: Ali Yildirim, Waiblingen (DE); Timo Staiber, Ingersheim (DE)

(73) Assignee: BFC Fahrzeugteile GmbH, Bietigheim-Bissingen (DE)

( * ) Notice: Subject to any disclaimer, the term of this patent is extended or adjusted under 35 U.S.C. 154(b) by 65 days.

(21) Appl. No.: 18/696,427

(22) PCT Filed: Oct. 4, 2022

(86) PCT No.: PCT/EP2022/077513
§ 371 (c)(1),
(2) Date: Mar. 28, 2024

(87) PCT Pub. No.: WO2023/057417
PCT Pub. Date: Apr. 13, 2023

(65) Prior Publication Data

US 2024/0392575 A1 Nov. 28, 2024

(30) Foreign Application Priority Data

Oct. 4, 2021 (DE) ..... 10 2021 125 645.3

(51) Int. Cl.
*E04F 13/00* (2006.01)
*B21D 47/02* (2006.01)
(Continued)

(52) U.S. Cl.
CPC ..... *E04F 13/06* (2013.01); *B21D 47/02* (2013.01); *E04F 19/064* (2013.01); *E04F 2013/063* (2013.01)

(58) Field of Classification Search
CPC ... E04F 13/06; E04F 2013/063; E04F 19/064; B21D 47/00; B21D 47/02
See application file for complete search history.

(56) References Cited

U.S. PATENT DOCUMENTS 5,752,353 A * 5/1998 Koenig ..... E04F 13/06 52/287.1
6,295,776 B1 * 10/2001 Kunz ..... E04F 13/068 52/746.1
(Continued)

FOREIGN PATENT DOCUMENTS

AU 555 044 9/1986
DE 41 43 035 7/1993
(Continued)

*Primary Examiner* — Chi Q Nguyen
(74) *Attorney, Agent, or Firm* — Schroeder Intellectual Property Law Group, LLC

(57) ABSTRACT

A building profile having a first and a second strip-shaped profile leg and a connecting section which connects the first profile leg and the second profile leg in the longitudinal direction, wherein the profile legs form a profile angle. At least one of the profile legs has material apertures which are produced from through cuts by a stretching process. A method for manufacturing such a building profile; an installation for manufacturing a profiled strip comprising material apertures which forms a building profile precursor from which said building profiles are produced; an installation for manufacturing such a building profile from a profiled strip comprising material apertures which are produced from through cuts a stretching process; an apparatus for manufacturing such a building profile from a raw strip; and the use of an installation in the production of building profiles, in the form of angle profiles for protecting wall edges or corners or in the form of quick-plastering profiles or in the form of support rails or stand profiles, in the production of building profiles mentioned at the outset.

16 Claims, 8 Drawing Sheets

(51) Int. Cl.
*E04F 13/06* (2006.01)
*E04F 19/06* (2006.01)

(56) References Cited

U.S. PATENT DOCUMENTS

| | | | | |
|---|---|---|---|---|
| 6,571,520 | B2 * | 6/2003 | Koenig, Jr. | E04F 13/06 52/287.1 |
| 6,691,477 | B2 * | 2/2004 | Koenig, Jr. | E04F 13/06 52/287.1 |
| 6,722,092 | B2 * | 4/2004 | Kunz | E04F 13/06 52/255 |
| 7,013,610 | B2 * | 3/2006 | Kunz | E04F 13/06 52/255 |
| 8,756,886 | B1 * | 6/2014 | Grant | E04F 13/0733 52/287.1 |
| 8,910,437 | B2 * | 12/2014 | Robertson | E04F 13/06 52/255 |
| 9,303,413 | B2 * | 4/2016 | Koenig, Jr. | E04F 19/022 |
| 9,377,160 | B1 * | 6/2016 | Smythe | E04F 13/06 |
| 2002/0134035 | A1 * | 9/2002 | Koenig, Jr. | E04F 13/06 52/459 |
| 2011/0030297 | A1 * | 2/2011 | Robertson | B26F 1/384 52/287.1 |
| 2018/0051470 | A1 * | 2/2018 | Smith | E04F 19/062 |

FOREIGN PATENT DOCUMENTS

| | | |
|---|---|---|
| DE | 197 16 435 | 10/1998 |
| GB | 2 116 599 | 9/1983 |
| JP | S63-70748 | 3/1988 |

* cited by examiner

BUILDING PROFILE AS WELL AS METHOD AND INSTALLATIONS FOR MANUFACTURING A BUILDING PROFILE

RELATED APPLICATIONS

This application is a § 371 national phase of International Patent Application No. PCT/EP2022/077513 filed Oct. 4, 202, which claims priority to and the filing benefit of German Patent Application No. 10 2021 125 645.3 filed Oct. 4, 2021-the contents of both of which are incorporated herein by reference.

BACKGROUND OF THE INVENTION

1. Field of the invention

The invention relates to a building profile comprising a) a first and a second strip-shaped profile leg;

b) a connecting section, which connects the first profile leg and the second profile leg to one another in the longitudinal direction, wherein the profile legs form a profile angle;

wherein c) at least one of the profile legs has material apertures.

The invention also relates to a method for manufacturing such a building profile;

an installation for manufacturing a profiled strip comprising material apertures, which forms a building profile precursor from which the aforementioned building profiles are produced;

an installation for manufacturing such a building profile from a profiled strip comprising material apertures produced from through cuts by means of a stretching process;

an apparatus for manufacturing such a building profile from a raw strip;

and the use of an installation in the manufacture of building profiles, in particular in the manufacture of the building profiles mentioned at the outset.

2. Description of the prior art

Building profiles of the type mentioned above are used, for example, in the form of angle profiles in drywall construction as protective profiles to protect wall edges and corners or as quick plastering profiles for plastering or tiling work. The building profiles are applied to the corresponding edges or corners of masonry or, in the case of quick plaster profiles, over the entire surface of the masonry and plastered in. The profile legs must be relatively thin, especially in the case of protective profiles, as the plaster layers themselves can often only be applied up to a maximum thickness of 3 mm and the building profiles should be completely covered by the plaster. The material apertures in the building profile ensure better anchoring of the building profile in the building plaster. In another application, the building profiles are, for example, support rails or upright profiles for panel-shaped elements that are used when installing ceiling or wall cladding made from such elements.

These types of building profiles are mass-produced, which is why the material costs account for a considerable proportion of the manufacturing costs of the building profiles. The material apertures therefore also ensure that the amount of material is reduced compared to full-surface profile legs.

In building profiles of the type mentioned above that are known on the market, the material apertures are created by working out material in such a way that lumpy pieces of material, material chips or other material particles are produced as material waste.

This material waste can be collected and, after appropriate processing, reused as raw material or as an addition to raw material for building profiles. However, processing the material waste increases the production costs of the building profiles again, as separate process routes with the corresponding processing technology must be provided for this, which in turn require resources and energy for processing.

SUMMARY OF THE INVENTION

It is an object of the present invention to provide building profiles of the type mentioned at the outset, which take these ideas into account and can be produced in a more resource-saving manner and with a more favorable energy balance than known building profiles. In addition, the method, the installations, the apparatus and the use, which are mentioned at the outset, are to be provided for this resource-saving and energy-efficient production of the building profiles.

This object is achieved in a building profile of the type mentioned at the outset by d) the material apertures being produced from through cuts by means of a stretching process.

Ideally, through cuts can be produced without material loss and without material waste. The desired material apertures can then be produced from such through cuts using a stretching process; stretching expands the through cuts into the desired material apertures. If material waste is avoided, additional separate process routes are not required for its preparation; accordingly, the resources and energy required for this are saved. This also improves the $CO_2$ balance of the production of the building profile.

Preferably, through windows and/or edge gaps are provided as material apertures. These can advantageously both be created from through cuts.

For the applications mentioned at the outset, it is particularly advantageous if the building profile is an angle profile, in particular with a profile angle $\alpha$ of 90°, or a quick plaster profile, in which one or both profile legs are bent at their free longitudinal edges to form profile wings, or a support rail or a stand profile for holding panel-shaped elements.

In the method of the type mentioned at the outset, the above object is achieved by a method comprising the following steps:

(A) providing of a raw belt;

(B) carrying out a cutting process in which the raw strip is provided with through cuts so that a precursor strip having the through cuts is produced as an intermediate product;

(C) carrying out a stretching process in which the through cuts of the precursor strip are widened in the longitudinal direction so that a profiled strip comprising the material apertures is obtained as a building profile precursor;

(D) carrying out work processes by a plurality of building profiles are obtained from the profile strip.

These steps (A) to (D) allow the production of building profiles in a continuous manufacturing process from a raw strip, which can be stored in large quantities, for example on a storage roll. Accordingly, the process can be carried out with a high throughput and, as explained above, in a resource- and energy-efficient manner.

In particular, the through cuts in the precursor strip have an extension of between 0.01 mm and 0.4 mm in its longitudinal direction, preferably between 0.02 mm and 0.3 mm and further preferably between 0.05 mm and 0.2 mm.

Through cuts can be produced with little or very little material waste, for example by punching with correspondingly small-dimensioned punches—in this case, at least less material waste needs to be processed than is required with known techniques for producing material apertures in building profiles. This alone can reduce the amount of resources and energy required.

However, it is particularly advantageous if the cutting process in step (B) is a material-loss-free cutting process, as mentioned above.

For this purpose, the through cuts in step (B) are preferably produced by rotary cutting or laser cutting, wherein rotary cutting is once again preferred.

In the stretching process in step (C), there are the alternative options, each of which is advantageous in itself, of widening the through cuts in the longitudinal direction, (Ca) by subjecting the precursor strip to a roll stretching process; or (Cb) by subjecting the precursor strip to a displacement process in which a displacer structure is pressed into a respective through cut at a time; or (Cc) by subjecting the precursor strip to a lengthening process in which the precursor strip is subjected to tensile stress in the longitudinal direction; or (Cd) by subjecting the precursor strip to a stretch-straightening process; or (Ce) by subjecting the precursor strip to a roll-straightening process.

With regard to step (Cb), it can also be advantageous if steps (B) and (Cb) are carried out as a combined cutting and stretching process with blade/displacement elements in a common rotary work step.

The work processes in step (D) open up two manufacturing concepts with two alternative manufacturing routes and preferably include:

(a) cutting the profile strip to length to form profile segments and subsequent forming of the profile segments;

or (b) forming the precursor strip into a profile strand and then cutting the profile strand to length.

In addition, the method advantageously enables one, several or all of the work processes in step (D) to be carried out at the same location or at a different location to steps (A), (B) and (C). The process thus allows individual adaptation to local conditions. A different location can be a different operating site or just a locally different location at one and the same operating site.

In the first installation mentioned at the outset, the above object is achieved by a) a cutting device by means of which a precursor strip is produced by providing a raw strip with through cuts;

b) a stretching device by means of which the profiled strip is produced by widening the through cuts of the precursor strip in the longitudinal direction to the material apertures.

This installation makes it possible to form the material apertures in the building profile to be manufactured by producing a strip-shaped building profile precursor, namely the profile strip, with the desired material apertures already made, taking into account the resource-saving and energy-efficient process control.

Preferably, the cutting device is configured in such a way that through cuts are produced in the precursor strip which have an extension in the longitudinal direction of between 0.01 mm and 0.4 mm, preferably between 0.02 mm and 0.3 mm and further preferably between 0.05 mm and 0.2 mm.

With the advantages described above, it is advantageous if the cutting device is a rotary cutting device or a laser cutting device.

Advantageous in each case are the alternatives that the stretching device a) is a roll-stretching device in which the precursor strip can be subjected to a roll-stretching process; or b) is a displacer device in which the precursor strip can be subjected to a displacement process in which a displacer structure is pressed into a respective through cut; or c) is a lengthening device in which the precursor strip can be subjected to a lengthening process in which the precursor strip is subjected to tensile stress in the longitudinal direction; or d) is a stretch straightening device in which the precursor strip can be subjected to a stretch-straightening process; or e) is a roll straightening device in which the precursor strip can be subjected to a roll-straightening process.

With regard to the displacer device, it can be advantageous that the device for rotary cutting and the displacer device are combined in a rotary cutting-stretching device, in which the through cuts can be produced by means of combined blade/displacer elements in a rotary working step and can be widened in the longitudinal direction.

In the second installation mentioned at the outset, the above object is achieved by a) a strip-cutting device by means of which the profiled strip can be cut to profile segments, and a forming device by means of which the profile segments can be formed into the building profile;

or b) a strand forming device by means of which the profiled strip can be formed into a profiled strand, and a strand cutting device by means of which the profiled strand can be cut to length to form building profiles.

This installation allows the resource-saving and energy-efficient production of the building profile to be completed in a continuous and effective process.

Accordingly, the above-mentioned object is achieved in the apparatus mentioned at the out-set by comprising the installation explained as the first with some or all of the features explained in relation thereto and the installation explained as the second. The apparatus then has all the essential features for producing the building profiles in an effective manner and with the greatest possible use of resources and energy at one and the same operating site.

According to the invention, with regard to the above-mentioned use of an installation, it was recognized that resources and energy can be saved in the production of building profiles by using an installation comprising a) a cutting device by means of which a precursor strip having through cuts can be produced by providing a raw strip with through cuts;

and b) a stretching device by means of which a profiled strip comprising material apertures can be produced by widening the through cuts of the precursor strip in a longitudinal direction to form the material apertures.

Such installations have so far only been used on the market to produce metal strips that serve as inserts for sealing strips, acting as a kind of carrier for a sealing material and in which the sealing strips are encased in the sealing material.

BRIEF DESCRIPTION OF THE DRAWINGS

Embodiments of the invention are explained in more detail below with reference to the drawings. In these.

DESCRIPTION OF PREFERRED EMBODIMENTS

Figure 1:
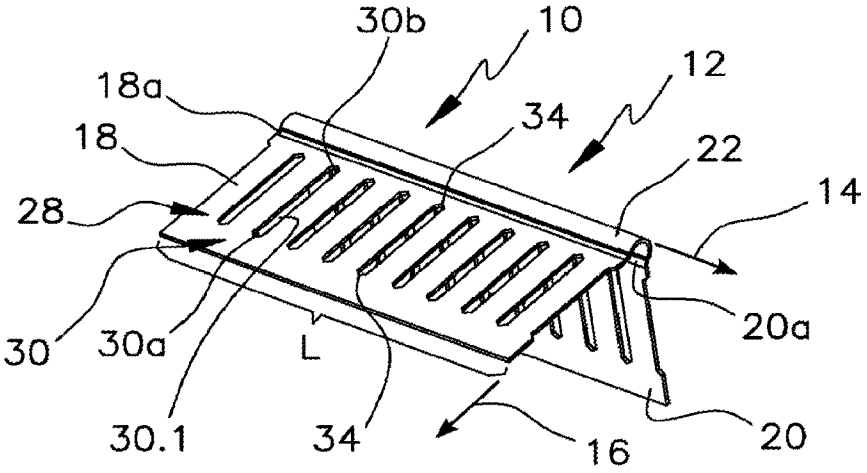
FIG. 1 shows a perspective view of a first embodiment of a building profile according to the invention comprising strip-shaped profile legs, which have material apertures in the form of through windows.
Figure 2:
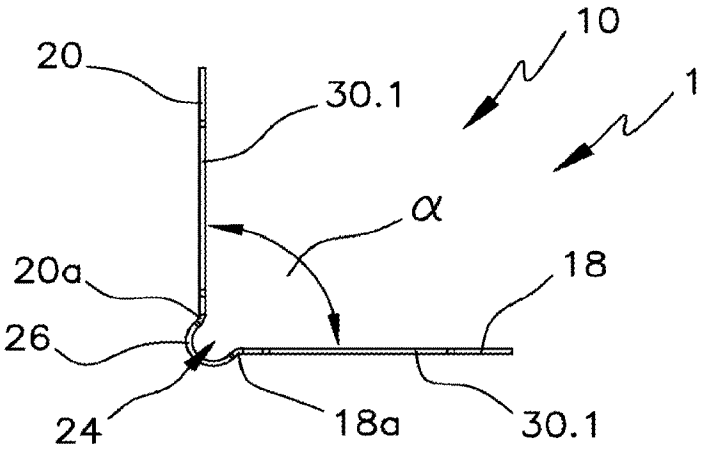
FIG. 2 shows a cross-section of the building profile according to FIG. 1.
Figure 16:
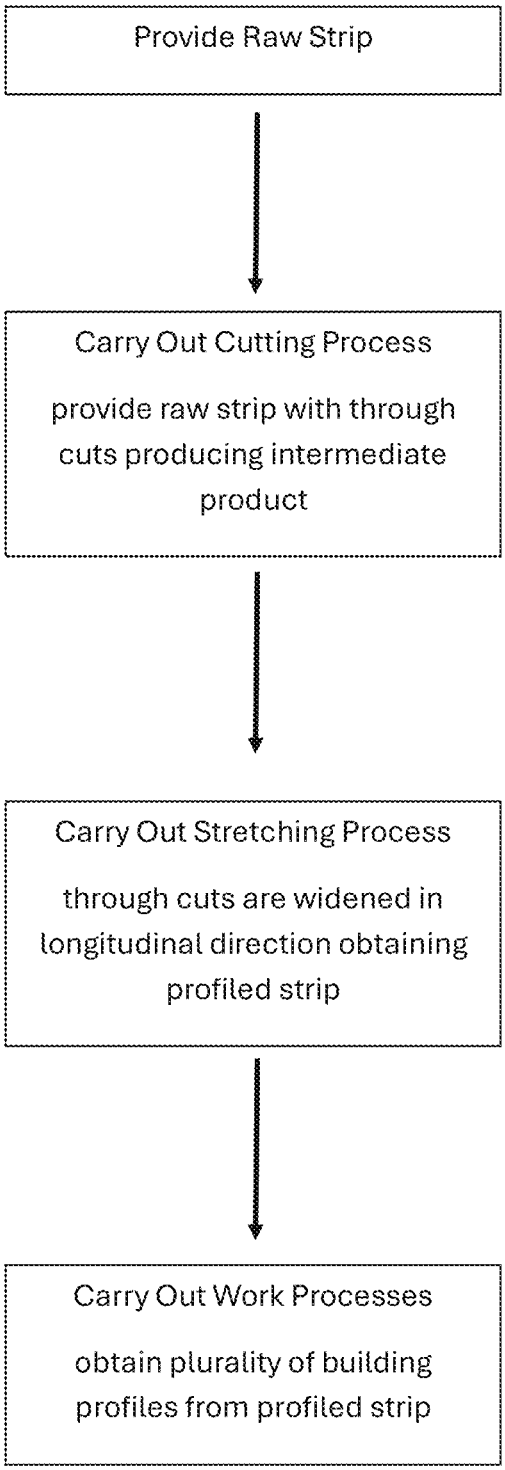
FIG. 16 shows a flow chart for the method of the present invention.

FIGS. 1 and 2 show a building profile in the form of an angled profile 12, which defines a longitudinal direction 14 and a transverse direction 16 perpendicular thereto and has a length L. The building profile 10 comprises a first strip-shaped profile leg 18 and a second strip-shaped profile leg 20, which are connected to one another at their opposite longitudinal edges 18*a* and 20*a* by a connection section 22 at a profile angle α. A flow chart showing a method for creating such a building profile can be seen at FIG. 16.

The profile legs 18, 20 have a thickness of less than 1 mm, in particular between 0.8 mm and 0.2 mm. In practice, the profile legs 18, 20 have a thickness of approximately 0.4 mm.

The building profile 10 shown in FIGS. 1 and 2, i.e. specifically the angle profile 12, is used in particular for drywall construction to protect wall edges and corners against damage. In the present embodiment, the profile angle α has a value of 90°, but can also have values, for wall edges and corners other than 90°, that are adapted to this.

In practice, the building profile 10 is made of aluminum or steel, in particular stainless steel or galvanized steel. If necessary, the building profile 10 can also be provided with a coating, for example made of plastic.

In the present embodiment, the connecting section 22 provides a space 24 extending in the longitudinal direction 14, into which the wall edge or corner to be protected can dip, as it were. For this purpose, the connecting section 22 follows a circular arc in cross-section, so that a circular cylindrical arc 26 is formed, which protrudes outwards in cross-section over the profile legs 18, 20; this can be clearly seen in FIG. 2. In a modification, the connecting section 22 can also have a cross-sectional shape other than an arc of a circle and, in particular, an angled shape. In a further modification, the profile legs 18 and 20 can also abut directly against each other, so that no such space 24 is formed.

At least one, in the present embodiments each profile leg 18, 20 of the building profile 10, has a plurality of material apertures 28. These material apertures 28 are arranged periodically in the longitudinal direction 14, with all distances in the longitudinal direction 14 between two adjacent material apertures 28 in the longitudinal direction 14 being the same in all embodiments shown here. In variations not specifically shown, however, these distances can also be different, although groups of material apertures are or can again be arranged periodically in the longitudinal direction 14; this can result from the manufacturing process, which will be discussed further below.

The material apertures 28 can be in the form of through windows 30 or in the form of edge gaps 32. A through window 30 is to be understood as a passage through the profile leg 18, 20, which is surrounded by material over its entire circumference. In the present embodiments, the through windows 30 are slot-shaped and extend in the transverse direction 16 between an outer end 30*a* and an inner end 30*b* with respect to the connecting portion 22.

An edge gap 32, on the other hand, is open towards the side of the profile leg 18, 20 remote from the connecting section 20 and describes an outer, open end 32*a* and an opposite inner, closed end 32*b*.

In the building profile 10 in FIG. 1, both profile legs 18, 20 only have through windows 30, wherein these each describe an angled outer contour and are idealized as a hexagon flattened in the longitudinal direction 14, so that the ends 30*a*, 30*b* are designed as a wedge tip 34 with likewise idealized straight edges. Such through windows 30 are designated with 30.1. In practice, the geometry can deviate from this idealized geometry with strictly rectilinear edges and the edges can have a slightly outwardly curved course between the corners of the hexagon, wherein the corners can also be slightly rounded in this case.

Figure 3:
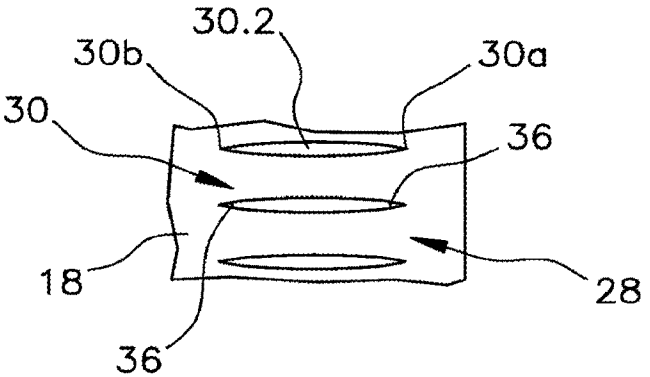
FIG. 3 shows a section of a profile leg comprising modified through windows.

FIG. 3 shows, as a variation, a section of the profile leg 18 comprising through windows 30.2, each of which is formed as a "bicorner", the ends 30*a*, 30*b* of which each form a point 36, between which the edges of the through window 30.2 extend curved outwards.

Figure 4:
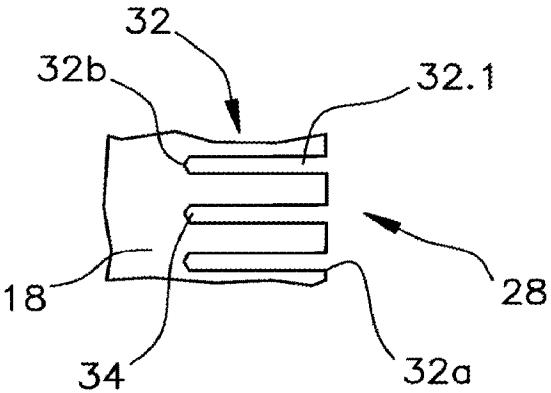
FIG. 4 shows a section of a profile leg comprising material apertures in the form of edge gaps.
Figure 5:
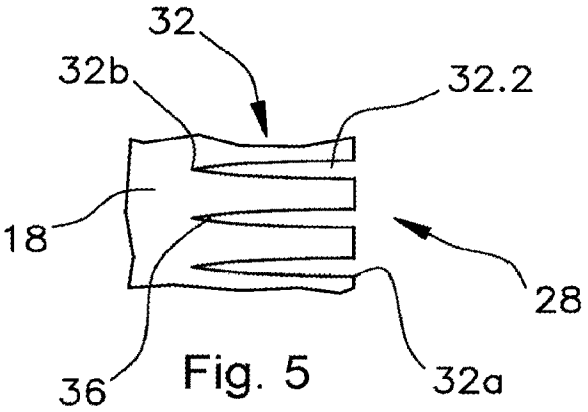
FIG. 5 shows a section of a profile leg comprising modified edge gaps.

FIGS. 4 and 5 each show a section of the profile leg 18 comprising edge gaps 32. FIG. 4 illustrates edge gaps 32.1, the geometry of which corresponds to the through windows 30.1 and the inner end 32*b* of which is formed as a corresponding wedge tip 34. FIG. 5 shows edge gaps 32.2, the geometry of which corresponds to the through windows 30.2. Their inner end 32*b* is therefore configured as a point 36.

Figure 6:
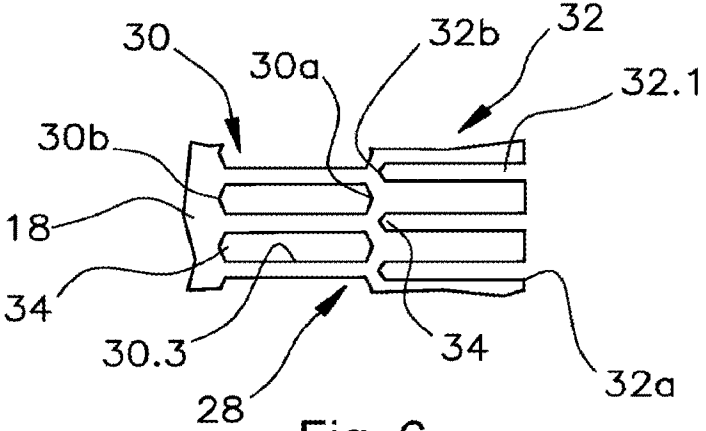
FIG. 6 shows a section of a profile leg comprising through windows and edge gaps.

FIG. 6 illustrates a variant in which the profile leg 18 has both through windows 30 and edge gaps 32, the hexagonal geometry of which corresponds to the through windows 30.1 and edge gaps 32.1. In the embodiment shown here, the through windows 30, which bear the reference sign 30.3, have as a modification a larger extension in the longitudinal direction 14 than the edge gaps 32.

Figure 7:
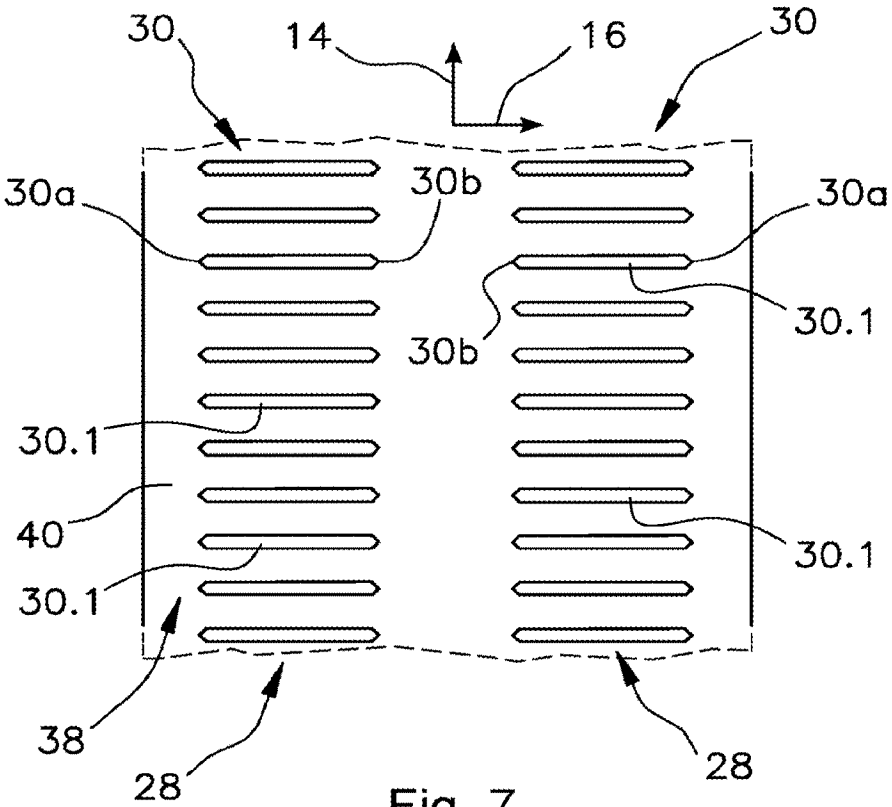
FIG. 7 shows a top view of a strip-shaped building profile precursor from which building profiles according to FIG. 1 are manufactured.

A building profile 10 is obtained from a building profile precursor in the form of a flat profile strip 38, which FIG. 7 illustrates by means of a section 40 of a strip-shaped profile strip 38, which is configured in such a way that a number of building profiles 10 according to FIG. 1 can be produced from it in further manufacturing steps and which already has the corresponding material cutouts 28 in the form of the through windows 30.1 for this purpose.

For this purpose, work processes are carried out to obtain several building profiles 10 from the building profile precursor in the form of the profile strip 38.

Figure 8:
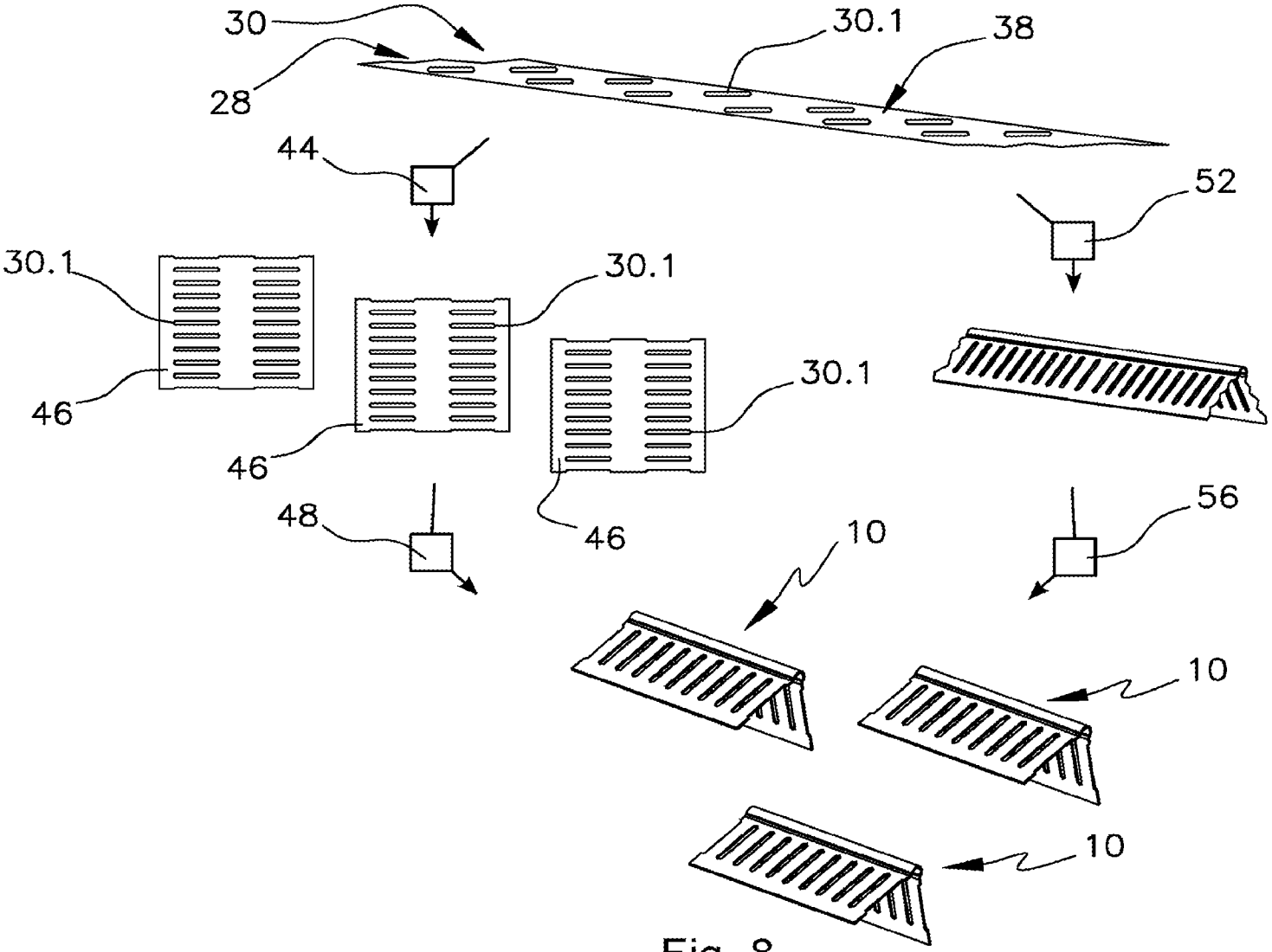
FIG. 8 schematically shows two alternative production methods in which several building profiles are produced from the building profile precursor according to FIG. 1.

In a first manufacturing process 42, illustrated in FIG. 8, flat profile segments 46 with the length L, i.e. with the length of the building profile 10 to be manufactured, are cut to length from the profile strip 38 in a first working process with the aid of a strip-cutting device 44, which is only indicated schematically. Suitable cutting devices are known from the prior art and therefore require no further explanation.

Typical lengths L of a building profile 10 are 0.5 m, 1.0 m, 1.5 m, 2.0 m, etc. and are specified according to requirements. Longer lengths of up to 10 m and more are also possible. However, relatively short building profiles 10 with lengths L of a few centimeters can of course also be produced in order to protect only short wall edge and corner areas. In this case too, however, the profile legs 18 and 20 should be understood to be strip-shaped, as introduced above.

In a second work process of the first manufacturing path 42, these flat profile segments 46 are each formed into the building profile 10 shown in FIG. 1 in a forming device 48, which is also only shown schematically. In practice, this is done by bending and folding. Suitable bending devices are known as such, which is why no further explanation is necessary.

In an alternative second manufacturing method 50, also illustrated in FIG. 8, the profiled strip 38 is formed, in particular bent and folded over, in a first working process with the aid of a strand forming device 52 to form a profiled strand 54, the cross-section of which already corresponds to the building profile 10 to be produced.

This profile strand 54 is then cut to building profiles 10 of length L in a second work process of the second production path 50 with the aid of a strand cutting device 56.

The strand forming device 52 and the strand cutting device 56 are also only schematically indicated; suitable devices are again known as such.

Figure 9:
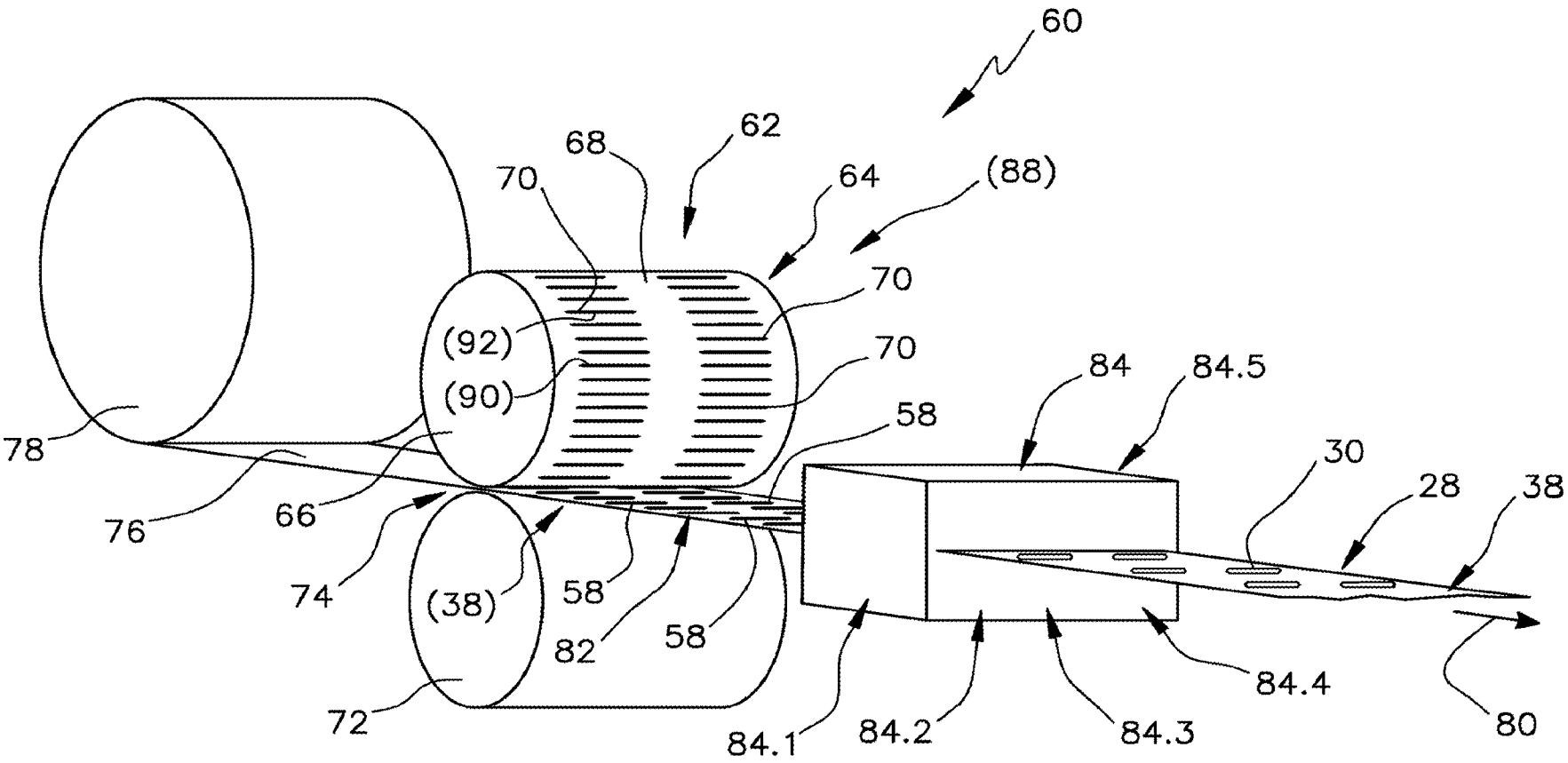
FIG. 9 schematically shows an installation for producing the building profile precursor, which comprises a device for rotary cutting and a stretching device for stretching a material strip.

As FIG. 9 illustrates, the material apertures 28 of the building profile 10 are produced from through cuts 58 by means of a stretching process. FIG. 9 shows an installation, labeled 60, for producing the profile strip 38 as a building profile precursor.

In the following, the reference signs assigned to a device also always designate the associated process that is carried out with the device.

The installation 60 comprises a cutting device 62 with which a cutting process 62 is carried out and which, in the present embodiment, is designed as a device 64 for rotary cutting. For this purpose, the device 64 for rotary cutting comprises a cutting roller 66, which carries a plurality of radially projecting cutting blades 70 on its outer surface 68.

The cutting roller 66 works together with a counter roller 72, which is designed to complement the cutting roller 66 and with which it forms a pair of rollers 74. For this purpose, the counter roller 72 can, for example, have at least one outer surface made of a flexible, preferably elastic, material, for example rubber, into which the cutting blades 70 can press. Alternatively, the counter roller 72 can also have apertures complementary to the cutting blades 70, into which the cutting blades 70 can plunge during rotation.

A raw strip 76 is provided, which is unrolled from a supply roller 78 in a conveying direction 80, which corresponds to the longitudinal direction 14 of the building profile 10 to be produced.

For the sake of clarity, the fastening and bearing devices for the rollers 66 and 72 or the supply roller 78 as well as the necessary guides and drives are not shown.

In general terms, a cutting process 62 is carried out by means of the cutting device 62, in which the raw strip 76 is provided with through cuts 58. As a result of this cutting process 62, a precursor strip 82 is produced as an intermediate product, which has the through cuts 58.

In the present embodiment, the raw strip 76 is guided between the cutting roller 66 and the counter roller 72 for this purpose. As it passes through the pair of rollers 74, the raw strip 76 is provided with the through cuts 58.

In practice, the through cuts 58 have a width, i.e. in the conveying direction 80 or in the longitudinal direction 14 an extension between 0.01 mm and 0.4 mm, preferably between 0.02 mm and 0.3 mm and further preferably between 0.05 mm and 0.2 mm. The material thickness of the raw belt 76 on the one hand and the geometry of the cutting blades 70 and their distance from one another in the circumferential direction on the other hand have a particular influence on this width of the through cuts 58.

If the building profile 10 to be produced is to have edge gaps 32, corresponding cutting blades 70 are arranged on the cutting roller 66 in such a way that they produce open through cuts 58 on the outside of the precursor belt 82 in the transverse direction 16.

During rotary cutting in the device 64, the through cuts 82 are produced from the raw strip 76 without any loss of material, i.e. no material waste is produced. This is a material loss-free cutting process.

The cutting process therefore differs from other technical processes that may also be suitable here, such as punching, in which pieces of material are cut out as material waste, or machining processes such as drilling or milling, in which material chips are produced as material waste.

As an alternative for a suitable cutting process without material loss, for example, laser cutting can be considered and the cutting device 62 is a laser cutting device. Even if, strictly speaking, a loss of material occurs there, since the material is thermally removed along the cutting line, this loss of material is negligible, provided that only linear through cuts 58 are produced, as is the case here, and thus no material parts remaining in pieces are cut out and also no material chips or other material particles are produced. Therefore, laser cutting is also understood as a cutting process without material loss when generating through cuts 58.

In connection with the device 64 for rotary cutting, the geometries, arrangements and dimensions of the material apertures 28 of the building profile 10 or of the preceding profile strip 38 depend on the geometries, arrangements and dimensions of the cutting blades 70 on the cutting roller 66. The geometries explained above for the through windows 30 and edge gaps 32 are therefore to be understood as purely exemplary. The cutting roller 66 is shown here only as an example with identical cutting blades 70 in a regular sequence and arrangement in order to explain the formation of the specific embodiment of the building profile 10 shown in FIG. 1.

Now the precursor strip 82 is subjected to a stretching process in which the through cuts 58 are widened in the longitudinal direction 14 to form the material apertures 28, so that the profiled strip 38 comprising the material apertures 28 is obtained as the building profile precursor.

For this purpose, the installation 60 comprises a stretching device 84, in which the through cuts 58 of the precursor strip 82 are widened until the material apertures 28, here the through windows 30 and otherwise possibly also edge gaps 32, are formed as they are then to be present in the finished building profile 10.

As explained at the beginning, the stretching process 84 can be carried out in various ways.

Figure 10:
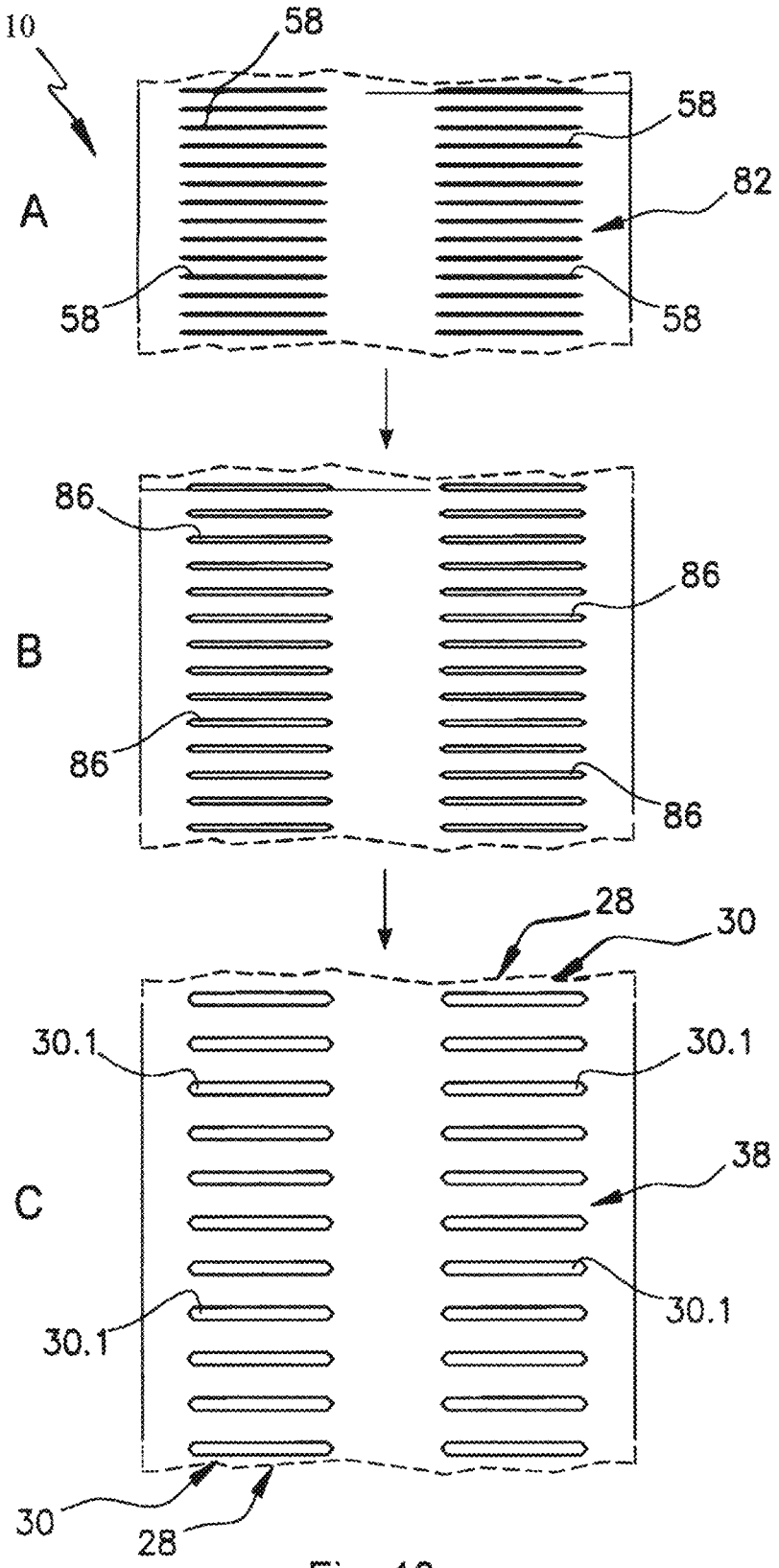
FIG. 10 shows an illustration of a roll stretching process for the production of the building profile precursor according to FIG. 8 using three phases A, B and C.

FIG. 10 illustrates the alternative that the stretching device 84 is a roll stretching device 84.1 and that precursor strip 82 is subjected to a roll stretching process 84.1. FIG. 10 shows how appropriately positioned and dimensioned through cuts 58 in the precursor strip 82, which can be seen in FIG. 10A, are successively widened by the roll stretching device 84.1 until the profiled strip 38 is produced, which is shown in FIG. 10C and has the through windows 30.1. In the process, intermediate states are passed through, one of which is shown in FIG. 10B and in which the through cuts 58 are already widened in the longitudinal direction 14 to form through openings 86. The material apertures 28 are then created from these in the further roll stretching process 84.1.

Otherwise, the technique of roll stretching is known as such, which is why no further explanation is necessary.

As a result of this roll stretching process 84.1 in the roll stretching device 84.1, the profiled strip 38 is then present, from which building profiles 10 are then obtained using the working processes described above with reference to FIG. 8 via the first or second manufacturing path 42 or 50.

Alternatively, the stretching device 84 can be a displacer device 84.2 and the precursor strip 82 can be subjected to a displacement process 84.2 in which a displacer structure is pressed into a respective through cut 58. Such a displacer structure can be, for example, a conical cross-section indenting punch which has an immersion end complementary to the through cut 58 to be expanded and widens in the opposite direction to the direction of indentation. When such indenting punches then plunge into the through cuts 58 and are pressed in further, the indenting punches widen the through cuts 58 until the material apertures 28 and thus the profiled strip 38 are formed.

The displacer device 84.2 can, for example, operate rotationally and for this purpose have a displacer roller, on the outer surface of which the displacer structures are present and which cooperates with a correspondingly complementary counter roller, as described analogously above for the device for rotational cutting 64. In this case, the displacer roller and the precursor belt 82 must be synchronized so that the displacer structures meet the through cuts 58.

The device for rotary cutting 64 and the displacer device 84.2 can also be combined in a rotary cutting-stretching device 88, in which the through cuts 58 can be produced by means of combined blade/displacer elements 90 in a rotary working step and can be widened in the longitudinal direction 14. In FIG. 9, the reference signs in connection with the rotary cutting-drawing device 88 are indicated in brackets.

In FIG. 9, the cutting roller 66 then bears the aforementioned blade/displacer elements 90, the free ends of which form the cutting blades 70 and the sections of which lying radially in the direction of the cutting roller 66 form the displacer structure, which now bears the reference sign 92 there.

In this cutting-stretching process 88, the cutting process 62 for a through cut 58 is completed when the blade/displacer element 90 has penetrated the raw strip 76. From this moment, the displacement process 84.2 begins; the through cuts 58 are widened by the displacer structure 92, which is then pressed in further.

The profiled strip 38 is then present as the result of this cutting-stretching process 88 in the cutting-stretching device 88. The separate stretching device 84 shown in FIG. 9 and the profiled strip 38 emerging therefrom are therefore not present or are not included in the cutting-stretching device 88.

As a further alternative, the stretching device 84 can be a lengthening device 84.3, in which the precursor strip 82 can be subjected to a lengthening process in which the precursor strip 82 is subjected to tensile stress in the longitudinal direction 14. As a result of the elongation thus achieved, the through cuts 58 widen in the longitudinal direction towards the material apertures 28 until the corresponding profiled strip 38 is present.

Again alternatively, the stretch device 84 may be a stretch-straightening device 84.4 in which the precursor strip 82 is subjected to a stretch-straightening process 84.4. In a stretch-straightening process, the precursor strip 82 is clamped in a defined area and then subjected to tensile stresses beyond the yield point.

As yet another alternative, the stretching device 84 can be a roll straightening device 84.5, in which the precursor strip 82 can be subjected to a roll-straightening process 84.5. In a roll straightening-process, the precursor strip 82 is subjected to increasingly smaller alternating bends and is guided through a corresponding roller arrangement for this purpose.

When using the stretch-straightening process 84.4 or the roll-straightening process 84.5, it is avoided in particular that a profiled strip 38 curved in the longitudinal direction 14 is produced. These work processes can be carried out at the location of the installation 60. In particular, the devices 44 and 48 or 52 and 56 required for this purpose can be combined with the installation 60 to form an overall device for producing a building profile from a raw strip 76, so that the entire production of building profiles 10 can be carried out as a continuous manufacturing process at one and the same operating location.

Alternatively, the profiled strip 38 can also initially be stored temporarily, for example as a roll of profiled strip, and transported to another location. The necessary devices are then installed at this other location, with which the building profiles 10 can then be manufactured from the profiled strip 38 in the manner explained above. On the one hand, another location can be another operating site, but on the other hand it can also be merely a locally different location, for example another production hall, at one and the same operating site.

In the stretching processes, the precursor strip 82 is enlarged in the longitudinal direction 14 and possibly also in the transverse direction 16, while at the same time the material thickness is at least partially reduced. The dimensions of the raw strip 76 in the transverse direction 16 are therefore adjusted so that the profiled strip 38 obtained after the roll stretching process has such dimensions in the transverse direction 16 that the building profile 10 with the desired dimensions of the profile legs 18, 20 can be obtained therefrom, taking acceptable tolerances into account.

The profiled belt 38 is produced in a continuous process in which the raw belt 76, the precursor belt 82 with the through cuts 58 and the profiled belt 38 are continuously conveyed in the conveying direction 80.

The building profile 10 produced in this way shows the manufacturing process with a cutting process 62, in particular with a cutting process without material loss, and a subsequent stretching process 84. The skilled person can recognize this by the nature of the material structure and in particular by the edge contours formed and by the ends 30*a*, 30*b* of the material apertures 28.

Figure 11:
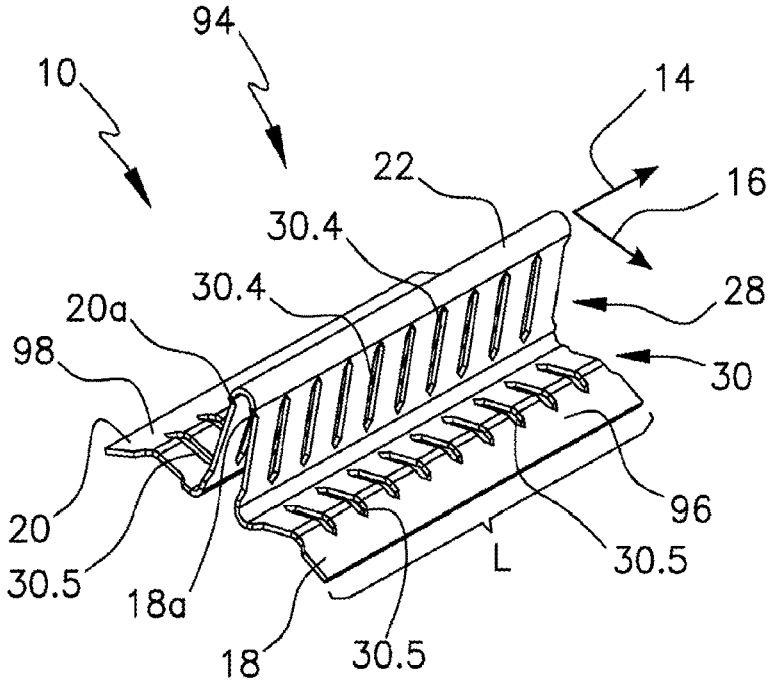
FIG. 11 shows a perspective view of a second embodiment of a building profile according to the invention.
Figure 12:
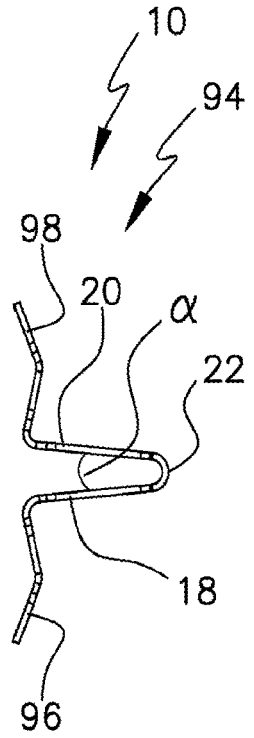
FIG. 12 shows a cross-section of the building profile shown in FIG. 11.

FIGS. 11 and 12 show a further embodiment of a building profile 10, a quick plaster profile 94. Such quick plaster profiles are used in particular for the formation of flat surfaces, for example by plastering or tiling. In the quick plaster profile 94, elements that have already been explained for the angle profile 12 have the same reference signs.

In the case of the quick plaster profile 94, the angle α between the profile legs 18, 20 is, by way of example, approximately 30°; in addition, the profile legs 18, 20 are each bent again at their free longitudinal edges in the transverse direction 16 to form curved profile wings 96 and 98 respectively, which define a support plane in which the quick plaster profile 88 is placed against a wall.

Figure 13:
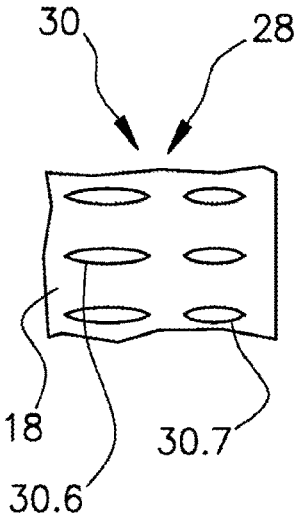
FIG. 13 shows a section of a profile leg comprising modified through windows.

In the section between the connecting section 22 and the profiled wings 96, 98, the profiled legs 18, 20 each have through windows 30.4 extending in the transverse direction 16. For their part, the profile wings 96, 98 each have passage windows 30.5 also extending in the transverse direction 16. The passage windows 30.5 are somewhat shorter in the transverse direction 16 than the passage windows 30.4. The passage windows 30.4 and 30.5 correspond in their basic geometry to the passage windows 30.1 and 30.3 of the angle profile 12, which have a hexagonal contour; the above applies here too. Here too, the passage windows generally designated 30 can have a "bicorner" geometry, as described above for the passage windows 30.2; this is illustrated in FIG. 13 by means of passage windows 30.6 and 30.7.

In a modification not shown here, the building profile can also be designed as a support rail or upright profile for panel-shaped elements, for example ceiling panels or wall panels. Such support rails or stand profiles are angled in cross-section in the manner required to accommodate the panel-shaped elements and form the desired ceiling or wall. In particular, U-shaped, C-shaped or T-shaped cross-sections are often used here. For such a support rail or such an upright profile with a T-shaped cross-section, the quick plastering profile 94 can be modified, for example, in such a way that the profile wings 96, 98 are not curved but flat, and the sections of the profile legs 18, 20 between the connecting section 22 and the profile wings 96, 98 run largely parallel to one another. This means that the profile angle α is very small in this case and is only a few degrees or can even be zero.

Building profiles that are to be used as protective profiles or quick plastering profiles can also be manufactured with cross-sections other than those specifically described here, depending on the intended use and location, and in particular also with a U-shaped, C-shaped or T-shaped cross-section.

Figure 14:
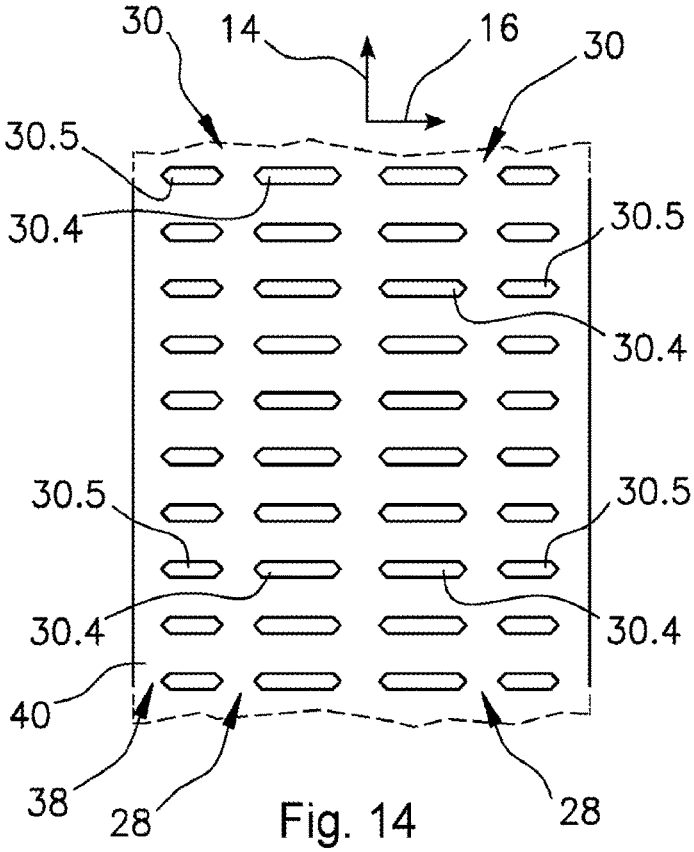
FIG. 14 shows a top view of a strip-shaped building profile precursor from which building profiles according to FIG. 11 are produced.

FIG. 14 also shows a building profile precursor in the form of a profiled strip 38, from which the building profile 10 according to FIG. 11 is manufactured. The above applies to the production of the building profile 10 according to FIG. 1.

Figure 15:
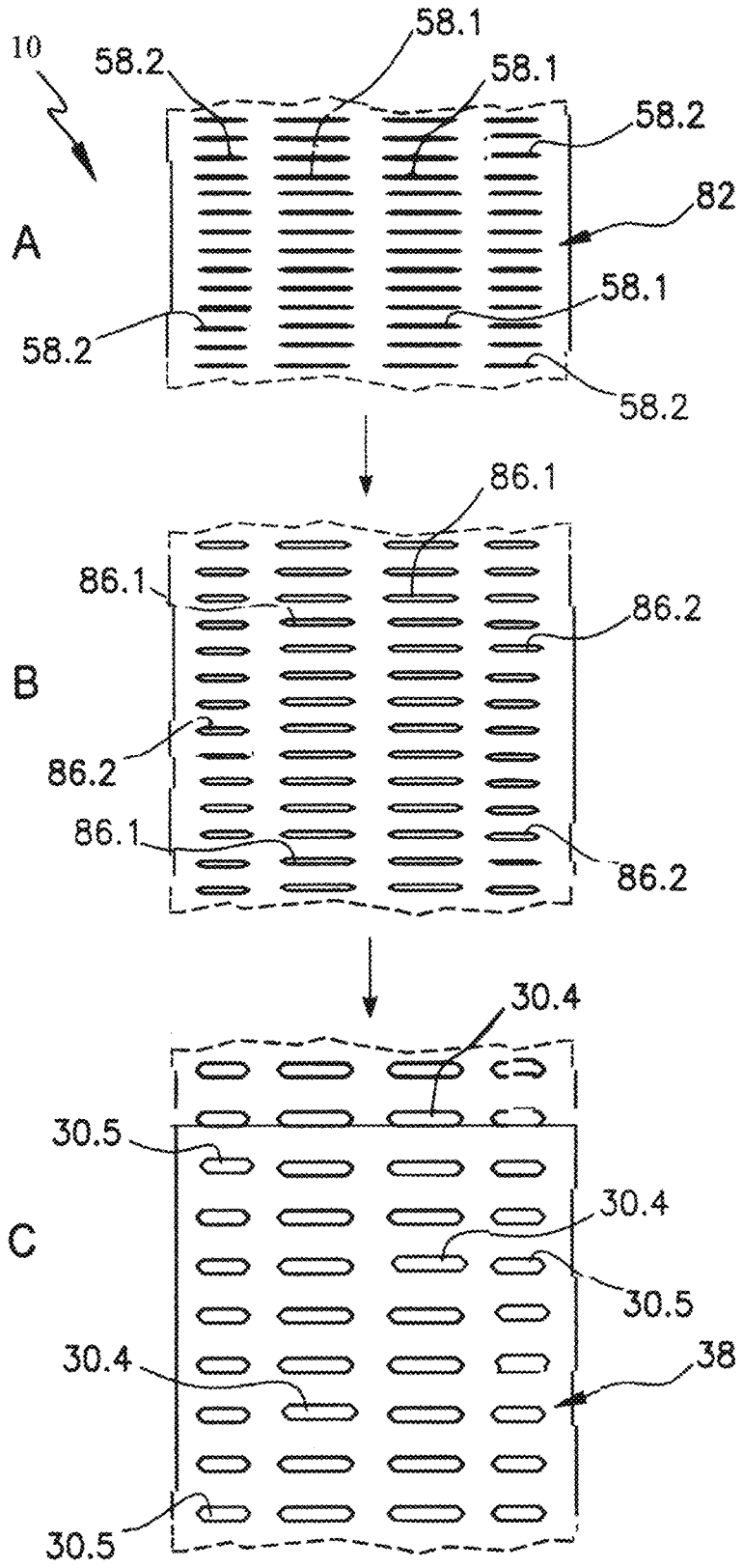
FIG. 15 shows an illustration of the roll stretching process for the production of the building profile precursor according to FIG. 11 using three phases A, B and C.

Accordingly, the precursor strip 82 shown in FIG. 15A is produced with two types of through cuts 58, designated 58.1 and 58.2, from a raw strip 76 with the aid of the cutting device 62. The cutting roller 66 of the latter carries correspondingly different cutting blades 70. The through cuts 58.1, 58.2 are then widened by the stretching device 84 until the profiled strip 38 with the through-windows 30.4 and 30.5 is produced, which is shown again in FIG. 15C. FIG. 15B again shows one of several intermediate states in which the through cuts 58.1, 58.2 are already widened in the longitudinal direction 14 to form through openings 86.1 or 86.2. The material apertures 28 are then formed from these in the further stretching process 84.

What is claimed is:

1. A method of manufacturing a building profile having a first and second strip-shaped profile leg with a connecting section connecting the first profile leg and the second profile leg to one another in a longitudinal direction so that the profile legs form a profile angle and at least one of the first profile leg or the second profile leg has material apertures, the method comprising the following steps:

(A) providing a raw strip;

(B) carrying out a cutting process where the raw strip is provided with through cuts so that a precursor strip having the through cuts is produced as an intermediate product;

(C) carrying out a stretching process where the through cuts of the precursor strip are widened in the longitudinal direction, so that a profiled strip comprising the material apertures is obtained as a building profile precursor;

(D) carrying out work processes where a plurality of building profiles are obtained from the profiled strip.

2. The method according to claim 1, wherein the cutting process in step (B) produces through cuts in the precursor strip having an extension in the longitudinal direction of between 0.01 mm and 0.4 mm.

3. The method according to claim 1, wherein the cutting process in step (B) is a material-loss-free cutting process.

4. The method according to claim 1, wherein the through cuts in step (B) are produced by rotary cutting or laser cutting.

5. The method according to claim 1, wherein in the stretching process in step (C) the through cuts are widened in the longitudinal direction, (Ca) by subjecting the precursor strip to a roll stretching process; or (Cb) by subjecting the precursor strip to a displacement process where a displacer structure is pressed into a respective through cut; or (Cc) by subjecting the precursor strip to a lengthening process where the precursor strip is subjected to tensile stress in the longitudinal direction; or (Cd) by subjecting the precursor strip to a stretch-straightening process; or (Ce) by subjecting the precursor strip to a roll-straightening process.

6. The method according to claim 5, wherein step (Cb) is carried out and steps (B) and (Cb) are carried out as a combined cutting-stretching process with blade/displacement elements in a common rotary working step.

7. The method according to claim 1, wherein the working processes in step (D) comprise:

(a) cutting the profile strip to length to form profile segments and subsequent forming of the profile segments;

or (b) forming the precursor strip into a profile strand and then cutting the profile strand to length.

8. The method according to claim 1, wherein one, several or all work processes in step (D) are carried out at the same location or at a different location than steps (A), (B) and (C).

9. An installation for manufacturing a profiled strip comprising material apertures, defining a building profile precursor, for producing building profiles, the building profiles having a first and second strip-shaped profile leg with a connecting section connecting the first profile leg and the second profile leg to one another in a longitudinal direction so that the profile legs form a profile angle and at least one of the first profile leg or the second profile leg has material apertures, the installation comprising:

a) a cutting device for producing a precursor strip is by providing a raw strip with through cuts;

b) a stretching device for producing the profiled strip by widening the through cuts of the precursor strip in the longitudinal direction to form the material apertures.

10. The installation according to claim 9, wherein the cutting device is configured in such a way that through cuts are produced in the precursor strip having an extension in the longitudinal direction of between 0.01 mm and 0.4 mm.

11. The installation according to claim 9, wherein the cutting device is a device for rotary cutting or a laser cutting device.

12. The installation according to claim 9, wherein the stretching device a) is a roll-stretching device where the precursor strip can be subjected to a roll-stretching process; or b) is a displacer device where the precursor strip can be subjected to a displacement process where a displacer structure is pressed into a respective through cut; or c) is a lengthening device where the precursor strip can be subjected to a lengthening process where the precursor strip is subjected to tensile stress in the longitudinal direction; or d) is a stretch-straightening device where the precursor strip can be subjected to a stretch-straightening process; or e) is a roll straightening device where the precursor strip can be subjected to a roll-straightening process.

13. The installation according to claim 12, wherein the device for cutting is a rotary cutting device and the displacer device are combined in a rotary cutting-stretching device, in which the through cuts can be produced by means of combined blade/displacer elements in a rotary working step and can be widened in the longitudinal direction.

14. Use of an installation according to claim 9, comprising:

a) a cutting device for producing a precursor strip having through cuts by providing a raw strip with through cuts; and b) a stretching device for producing a profiled strip comprising material apertures by widening the through cuts of the precursor strip in a longitudinal direction to form the material apertures;

during manufacture of building profiles, for protecting wall edges or corners or in the form of quick plastering profiles or in the form of support rails or stand profiles, in particular in the manufacture of building profiles comprising a first and a second strip-shaped profile leg;

a connecting section, which connects the first profile leg and the second profile leg to one another in the longitudinal direction, wherein the profile legs form a profile angle;

at least one of the profile legs has material apertures; and the material apertures are produced from through cuts by a stretching process.

15. An installation for manufacturing a building profile having a first and second strip-shaped profile leg with a connecting section connecting the first profile leg and the second profile leg to one another in a longitudinal direction so that the profile legs form a profile angle and at least one of the first profile leg or the second profile leg has material apertures, from a profile strip comprising material apertures which are produced from through cuts by a stretching process, which comprises:

a) a strip-cutting device for cutting the profiled strip to length to form profiled segments, and a forming device for forming the profiled segments into the building profile; or b) a strand-forming device for forming the profiled strip into a profiled strand, and a strand-cutting device for cutting the profiled strand to length to form building profiles.

16. An apparatus for manufacturing a building profile from a raw strip, the building profiles having a first and second strip-shaped profile leg with a connecting section connecting the first profile leg and the second profile leg to one another in a longitudinal direction so that the profile legs form a profile angle and at least one of the first profile leg or the second profile leg has material apertures, the installation comprising a cutting device for producing a precursor strip by providing a raw strip with through cuts;

a stretching device for producing the profiled strip by widening the through cuts of the precursor strip in the longitudinal direction to form the material apertures; and a strip-cutting device for cutting the profiled strip to length to form profiled segments, and a forming device for forming the profiled segments into the building profile; or a strand-forming device for forming the profiled strip into a profiled strand, and a strand-cutting device for cutting the profiled strand can be cut-to length to form building profiles.

* * * * *